United States Patent [19]

Oslin

[11] Patent Number: 4,933,140

[45] **Date of Patent: * Jun. 12, 1990**

[54] ELECTRICAL HEATING OF GRAPHITE GRAIN EMPLOYED IN CONSOLIDATION OF OBJECTS

[75] Inventor: Brian L. Oslin, Carmichael, Calif.

[73] Assignee: Ceracon, Inc., Sacramento, Calif.

[ * ] Notice: The portion of the term of this patent subsequent to Aug. 1, 2006 has been disclaimed.

[21] Appl. No.: 303,641

[22] Filed: Jan. 30, 1989

Related U.S. Application Data

[63] Continuation of Ser. No. 7/272,327, Nov. 17, 1988, Pat. No. 4,853,178.

[51] Int. Cl.[5] ..... G22F 1/00

[52] U.S. Cl. ..... 419/23; 419/31; 419/39; 419/52

[58] Field of Search ..... 419/49, 52, 23, 39, 419/31

[56] References Cited

U.S. PATENT DOCUMENTS

| | | | |
|---|---|---|---|
| 3,356,496 | 12/1967 | Hailey | 75/226 |
| 3,556,780 | 11/1970 | Holtz, Jr. | 75/203 |
| 3,561,934 | 2/1971 | Steven | 29/182.7 |
| 3,689,259 | 9/1972 | Hailey | 175/226 |
| 3,700,435 | 10/1972 | Chandhok | 75/214 |
| 3,706,579 | 12/1972 | Michael | 106/1 |
| 3,723,109 | 3/1973 | Lacock et al. | 75/214 |
| 3,746,518 | 7/1973 | Holtz, Jr. | 29/182.7 |
| 3,826,807 | 7/1974 | Green | 264/111 |
| 3,886,254 | 5/1975 | Tanaka | 264/332 |
| 3,992,200 | 11/1976 | Chandhok | 75/211 |
| 4,227,927 | 10/1980 | Black | 75/225 |
| 4,265,681 | 5/1981 | Krause et al. | 148/111 |
| 4,389,362 | 6/1983 | Larsson | 264/121 |
| 4,428,906 | 1/1984 | Rozmus | 419/48 |
| 4,446,100 | 5/1984 | Adlerborn et al. | 419/48 |
| 4,499,048 | 2/1985 | Hanejko | 419/49 |
| 4,499,049 | 2/1985 | Hanejko | 419/49 |
| 4,501,718 | 2/1985 | Bradt | 419/49 |
| 4,518,441 | 5/1985 | Hailey | 148/11.5 P |
| 4,539,175 | 9/1985 | Lichti et al. | 419/49 |
| 4,541,877 | 9/1985 | Stadelmaier et al. | 148/101 |
| 4,554,130 | 11/1985 | Ecer | 419/8 |
| 4,568,516 | 2/1986 | Adlerborn et al. | 419/26 |
| 4,597,456 | 7/1986 | Ecer | 175/371 |
| 4,602,957 | 7/1986 | Pollock et al. | 75/246 |
| 4,603,062 | 7/1986 | Ecer | 427/181 |
| 4,630,692 | 12/1986 | Ecer | 175/330 |
| 4,640,711 | 2/1987 | Lichti et al. | 75/248 |
| 4,656,002 | 4/1987 | Lizenby et al. | 419/10 |
| 4,667,497 | 5/1987 | Oslin et al. | 72/62 |
| 4,715,313 | 12/1987 | Ecer | 118/105 |

*Primary Examiner*—Stephen J. Lechert, Jr.
*Attorney, Agent, or Firm*—William W. Haefliger

[57] ABSTRACT

A method of consolidating a body in any of initially powdered, sintered, fibrous, sponge, or other form capable of compaction, including the steps: providing a bed of flowable particles within a contained zone, the particulate including flowable and resiliently compressible carbonaceous particles; positioning the body in the bed, to be surrounded by the particles; effecting pressurization of the bed to cause pressure transmission via the particles to said body, thereby to compact the body into desired shape, increasing its density; the particles being heated to elevated temperature prior to compacting of the body into desired shape; and the heating of the particles being effected by passing electric current through same, with heat generated in the particles also to be transferred to the body.

The electrically heated mass of particles may be fluidized; the particles may consist of graphite; and the body may consist of metal, ceramic, or synthetic resin.

44 Claims, 8 Drawing Sheets

ELECTRICAL HEATING OF GRAPHITE GRAIN EMPLOYED IN CONSOLIDATION OF OBJECTS

This is a continuation, of application Ser. No. 272,327, filed Nov. 17, 1988, now U.S. Pat. No. 4,853,178.

BACKGROUND OF THE INVENTION

This invention relates generally to the field of consolidating metallic bodies, and more particularly to rapid and efficient and heating and handling of granular media employed in such consolidation, as well as rapid and efficient heating and handling of pre-form powdered metal bodies to be consolidated.

The technique of employing carbonaceous particulate or grain at high temperature as pressure transmitting media for producing high density metallic objects is discussed at length in U.S. Pat. Nos. 4,140,711 and 4,539,175, the disclosures of which are incorporated herein, by reference.

Major problems in such processes include efficient heating of the media to usable high temperature, and handling of the thus heated media. Past methods used to heat the pressure transmitting media involved conventional box furnaces with glo-bars or Ni-Chrome wire heating elements. At first a container was used to hold the media during heating. This container was removed from the furnace for filling and emptying. Later, methods involved a fluidized bed retort to hold the media, surrounded by silicon carbide heating elements and insulation to prevent heat loss. The fluidized bed furnace proved to be faster and more efficient than the first method but not enough to be used in an efficient and rapid manufacturing process.

SUMMARY OF THE INVENTION

It is a major object of the invention to provide rapid and efficient electrical resistance heating of carbonaceous particles used as pressure transmitting media, and also transfer of heat generated in the particles to the work, i.e. the pre-form to be consolidated. Basic steps of the method of consolidating a metallic, metallic and ceramic, or ceramic body in any of initially powdered, sintered, fibrous, sponge, or other form capable of compaction, then include the steps:

(a) providing a bed of flowable particles within a contained zone, said particulate including flowable and resiliently compressible carbonaceous particles;

(b) positioning said body in said bed, to be surrounded by said particles;

(c) effecting pressurization of said bed to cause pressure transmission via said particles to said body, thereby to compact the body into desired shape, increasing the density;

(d) the particles being heated to elevated temperature prior to compacting of the body into desired shape; and (e) the heating of the particles being effected by passing electric current through same, and heat generated in the particles also to be transferred to said body.

Typically, electrode means is or are placed in a mass of the particles, and current is supplied to the electrode means; also, the heated mass of particles may be fluidized during current passage through the particles, such fluidization employing an inert gas such as nitrogen.

A further object includes placing the body or bodies (pre-forms to be consolidated) in heat receiving proximity to the particles through which current passes, so as to efficiently pre-heat the body or bodies for example by heat radiation and in an insulated enclosure. Such parts may then be passed through an enclosure, as within a tunnel which need not contain inert gas, thereby facilitating handling of the thus heated bodies.

It is a further object of the invention to facilitate electrical resistance heating of the grain particles outside the container (die) zone wherein the body is normally positioned for consolidation, the heated particles subsequently being transferred into that zone, and in an inert gas environment.

By the use of the methodology of the present invention, substantially improved structural articles of manufacture can be made having minimal distortion, as particularly enabled by the use of carbonaceous particulate in flowable form.

The novel features which are believed to be characteristic of this invention, both as to its organization and method of operation, together with further objectives and advantages thereof, will be better understood from the following description considered in connection with the accompanying drawings in which a presently preferred embodiment of the invention is illustrated by way of example. It is to be expressly understood, however, that the drawings are for the purposes of illustration and description only and are not intended as a definition of the limits of the invention.

DRAWING DESCRIPTION

Figure 2:
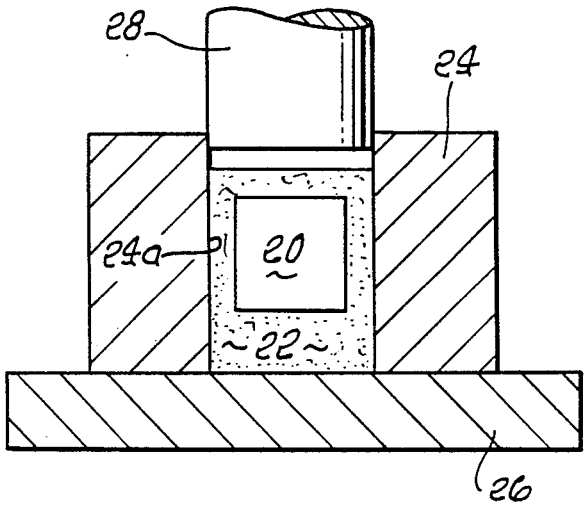
FIG. 2 is a cut-away elevation showing the consolidation step of the present invention.
Figure 6A:
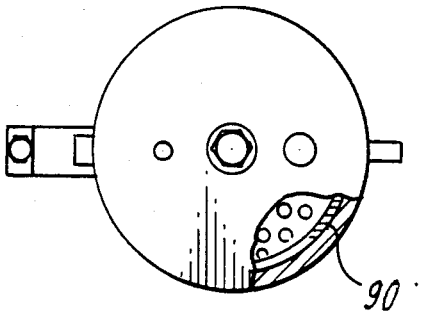
Figure 7A:
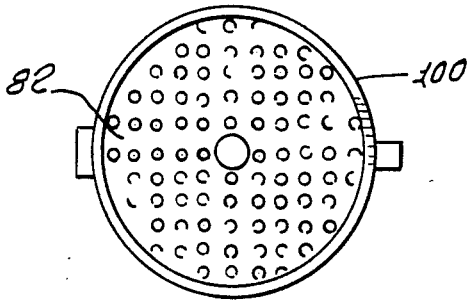
Figure 6:
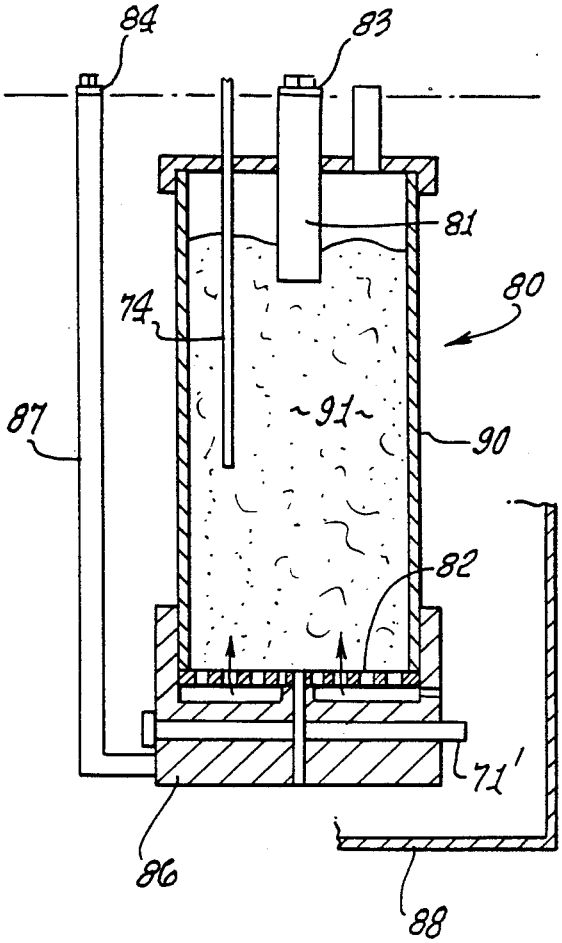
Figure 7:
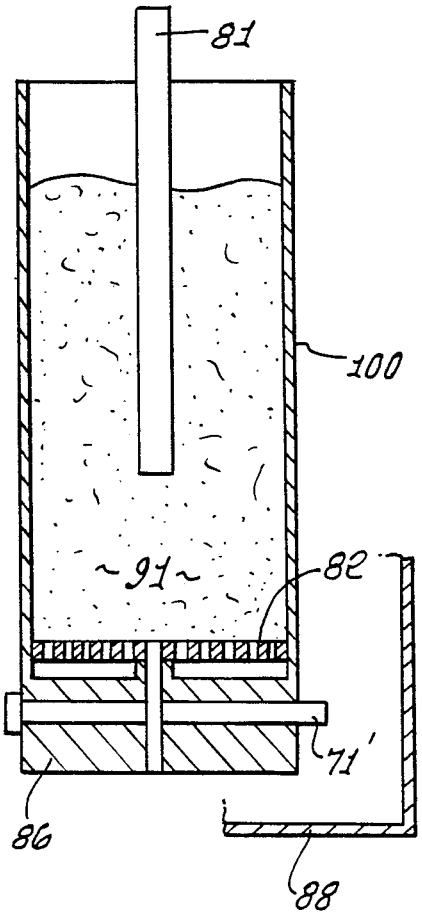
Figure 8:
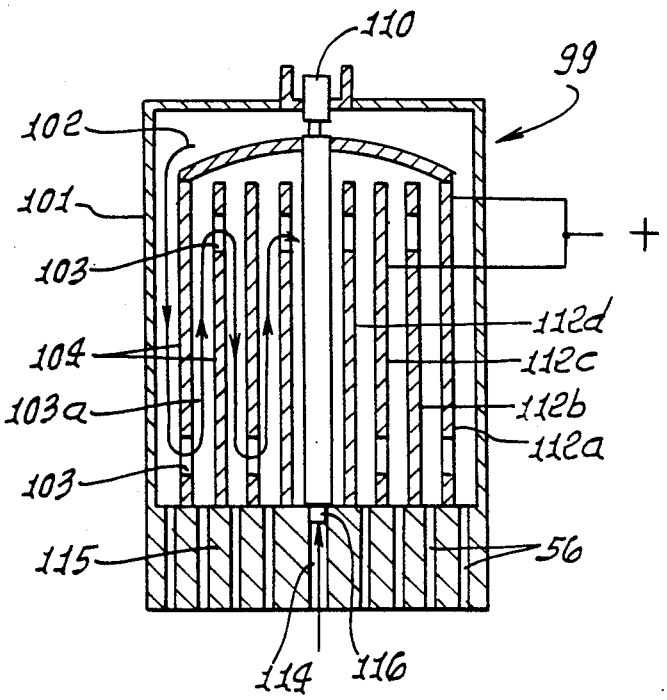
Figure 8A:
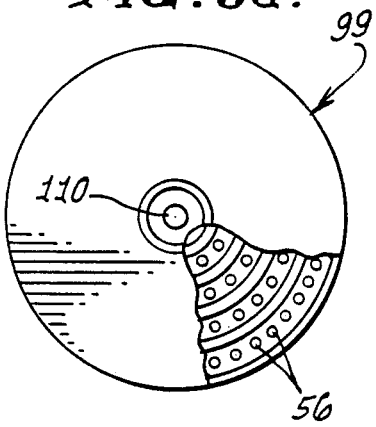
Figure 12:
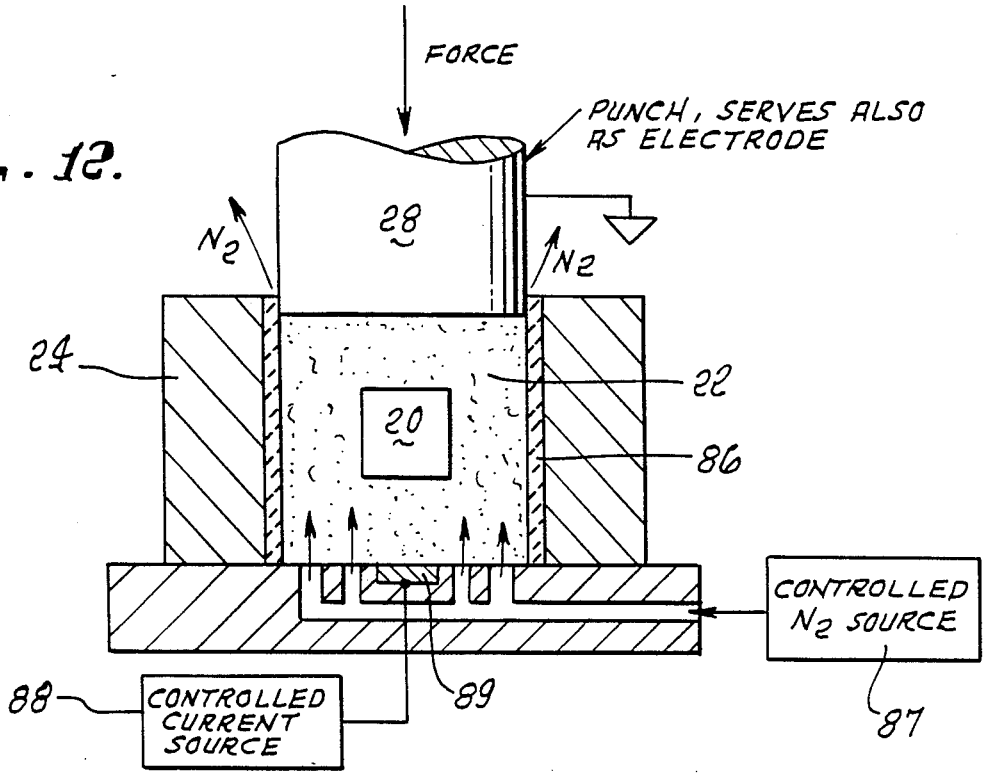
Figure 9:
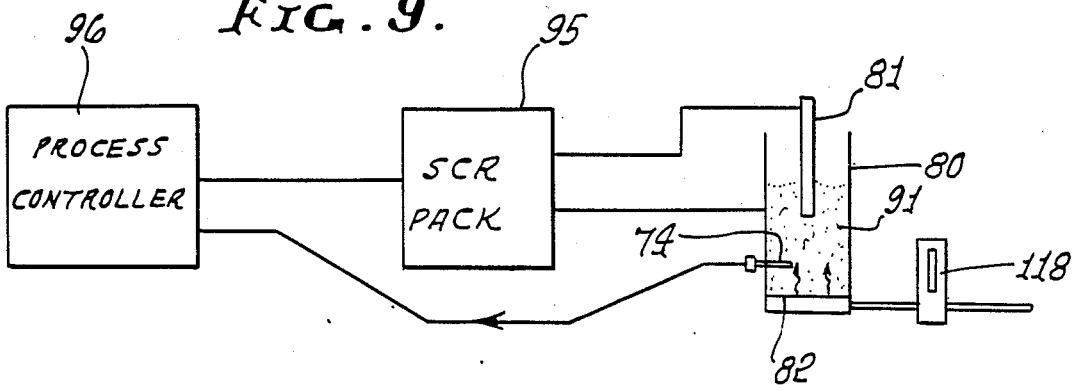
Figure 10:
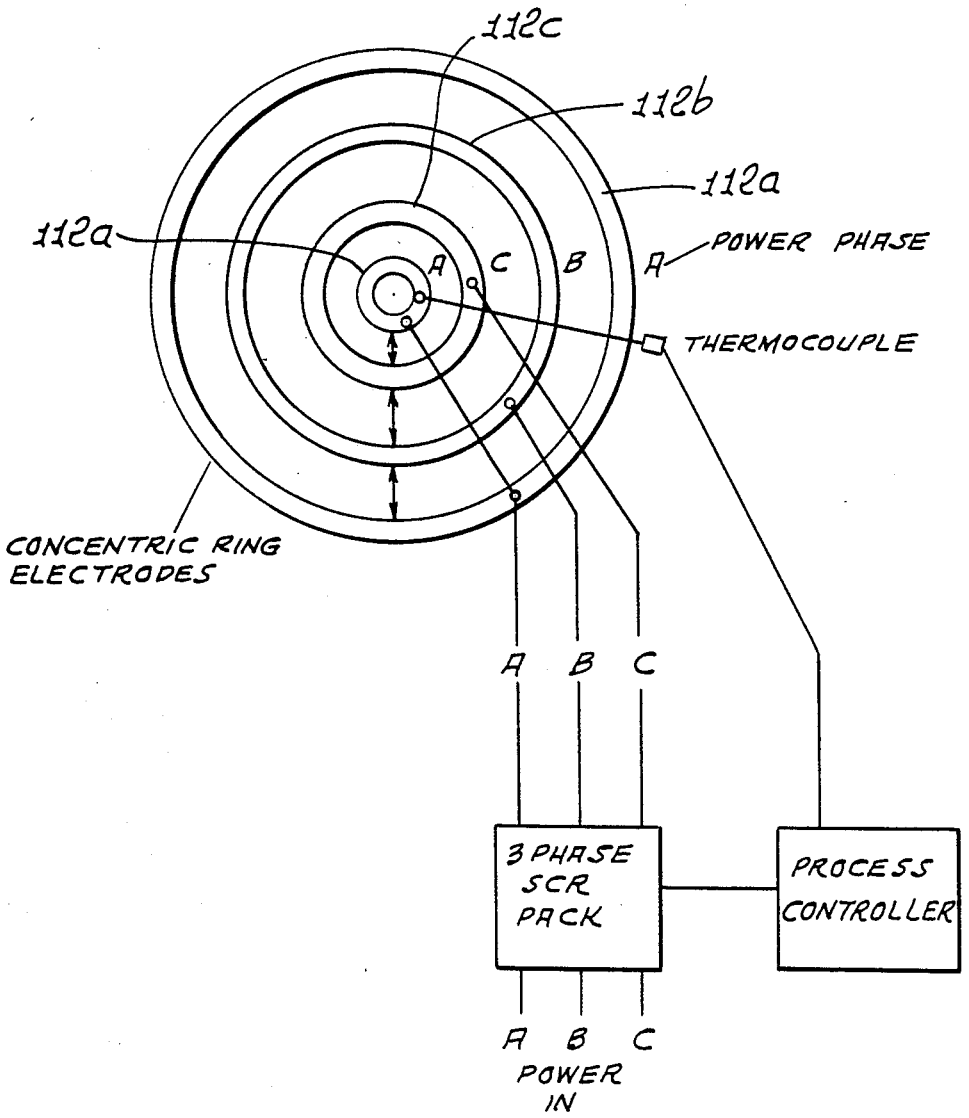
Figure 11:
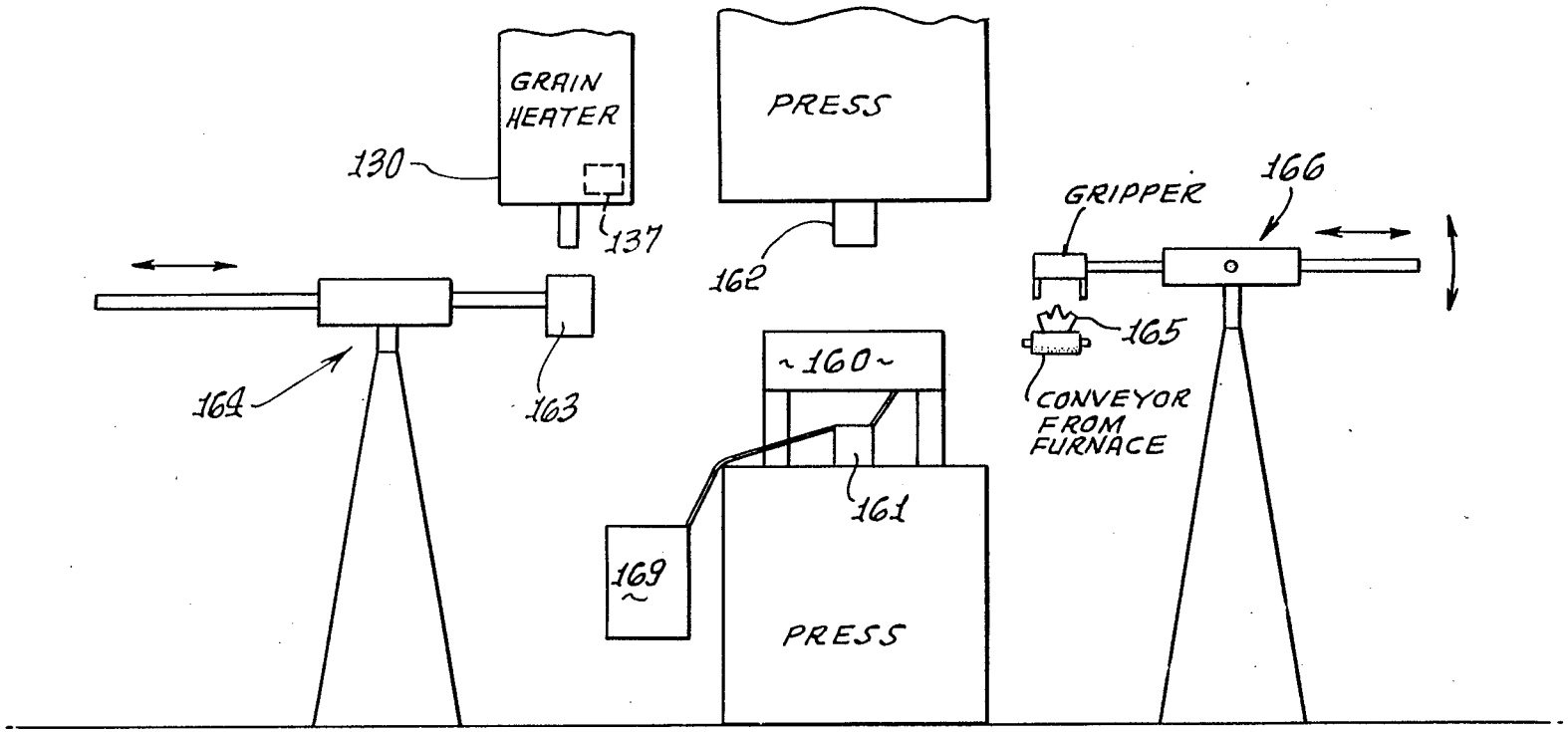
Figure 13:
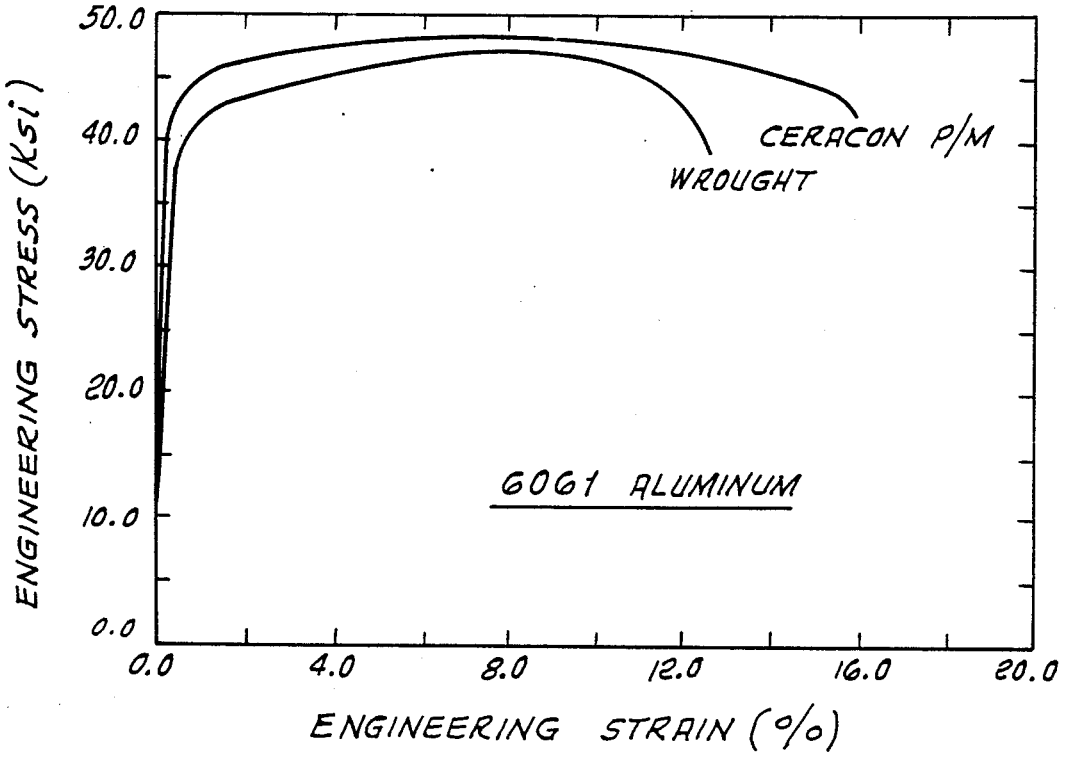
Figure 14:
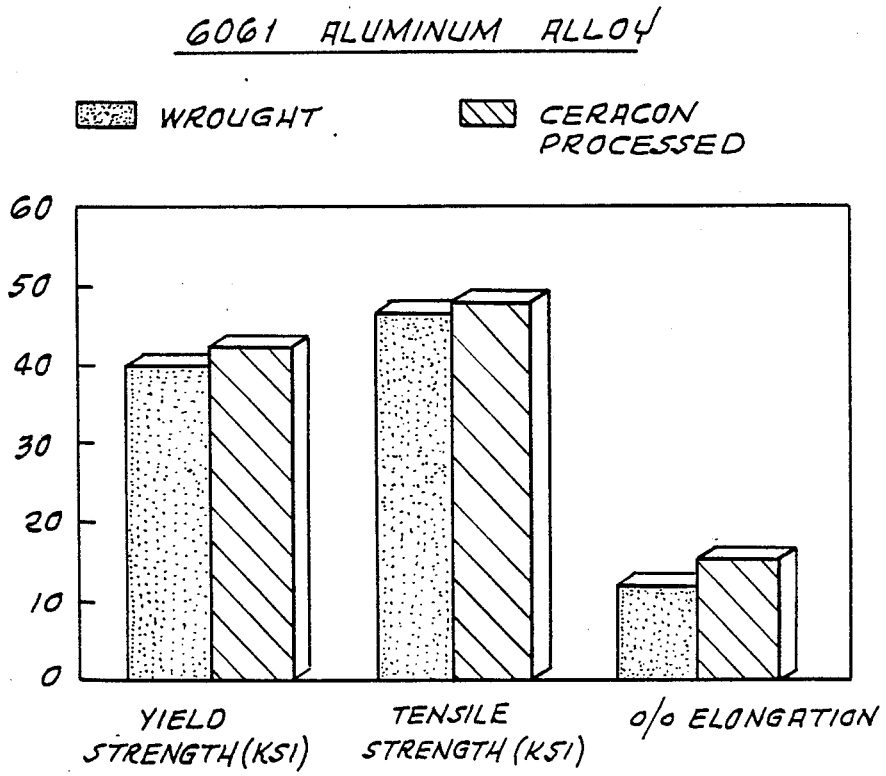

FIGS. 6*a*, 7*a*, and 8*a* are top plan view of the devices of FIGS. 6, 7, and 8, respectively;

FIG. 9 is a block diagram;

FIG. 10 is a diagram showing three phase current supply to a grain heater;

FIG. 11 is a system diagram;

FIG. 12 is a view like FIG. 2;

FIGS. 13 and 14 are graphs.

DETAILED DESCRIPTION

Figure 1:
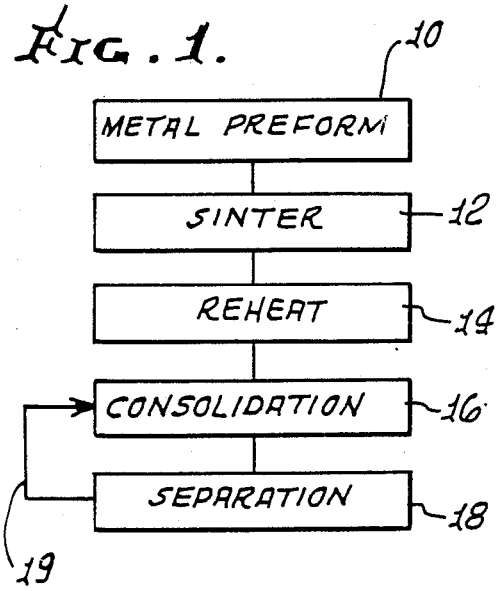
FIG. 1 is a flow diagram showing the method steps of the present invention.

Referring first to FIG. 1, there is shown a flow diagram illustrating the method steps of the present invention. As can be seen from numeral 10, initially a metal, metal and ceramic, or ceramic article of manufacture or pre-form is made, for example, in the shape of a wrench or other body. While the preferred embodiment contemplates the use of a metal pre-form made of powdered steel particles, other metals and ceramic materials, such as alumina, silica and the like, are also within the scope of the invention. A pre-form typically is about 85 percent of theoretically density After the powder has been made into a pre-formed shape, it is typically subsequently sintered in order to increase the strength. In the preferred embodiment, the sintering of the metal (steel) pre-form requires temperatures in the range of about 2,000° to 2,300° F. for a time of about 2–30 minutes in a protective atmosphere. In the preferred embodiment, such protective, non-oxidizing inert atmosphere is nitrogen-based. Subsequent to sintering, illustrated at 12, the pre-forms can be stored for later processing Should such be the case, as illustrated at 14, the pre-form is subsequently reheated to approximately 1950° F. in a protective atmosphere, or as disclosed herein.

The consolidation process, illustrated at 16, takes place after the hot pre-form has been placed in a bed of heated carbonaceous particles as hereinbelow discussed in greater detail. Further, in order to speed up production, consolidation can take place subsequent to sintering, so long as the pre-form is not permitted to cool. Consolidation takes place by subjecting the embedded pre-form to high temperature and pressure. For metal (steel) objects, temperatures in the range of about 2,000° F. and uniaxial pressures of about 40 TSI are used. Compaction at pressures of 10–60 TSI, depending on the material, are also within the scope of the present invention. The pre-form has now been densified and can be separated, as noted at 18, where the carbonaceous particles separate readily from the pre-form and can be recycled as indicated at 19. If necessary, any particles adhering to the preform can be removed and the final product can be further finished.

Final product dimensional stability, to a high and desirable degree, is obtained when the particle (grain) bed primarily (and preferably substantially completely) consists of flowable carbonaceous particles. For best results, such particles are resiliently compressible graphite beads, and they have outward projecting nodules on and spaced apart on their generally spheroidally shaped outer surfaces, as well as surface fissures. See for example U.S. Pat. No. 4,640,711. Their preferred size is between 50 and 240 mesh. Useful granules are further identified as desulphurized petroleum coke. Such carbon or graphite particles have the following additional advantages in the process:

1. They form easily around corners and edges, to distribute applied pressure essentially uniformly to and over the body being compacted. The particles suffer very minimal fracture, under compaction pressure.

1*a*. The particles are not abrasive, therefore reduced scoring and wear of the die is achieved.

2. They are elastically deformable, i.e. resiliently compressible under pressure and at elevated temperature, the particles being stable and unable up to 4,000° F.; it is found that the granules, accordingly, tend to separate easily from (i.e. do not adhere to) the body surface when the body is removed from the bed following compaction.

3. The granules do not agglomerate, i.e. cling to one another, as a result of the body compaction process. Accordingly, the particles are readily recycled, for reuse, as at 19 in FIG. 1.

4. The graphite particles become rapidly heated in response to passage of electrical current therethrough, i.e. by electrical resistance heating, whereby the FIG. 1 step 14 includes such electrical resistance heating. The particles are stable and usable at elevated temperatures up to 4,000° F. Even though graphite oxidizes in air at temperatures over 800° F., short exposures as during cooldown, do not harm the graphite particles.

Referring now to FIG. 2, the consolidation step is more completely illustrated. In the preferred embodiment, the pre-form 20 has been completely embedded in a bed of carbonaceous particles 22 as described, and which in turn have had placed in a contained zone 24*a* as in consolidation die 24. Press bed 26 forms a bottom platen, while hydraulic press ram 28 defines a top and is used to press down onto the particles 22 which distributes the applied pressure substantially uniformly to pre-form 20. The pre-form is at a temperature between 1,000° F. and 4,000° F., prior to compaction. The embedded metal powder preform 20 is rapidly compressed under high uniaxial pressure by the action of ram 28 in die 24, the grain having been heated by electrical resistance heating, to between 1,000° F. and 4,000° F.

Figure 4:
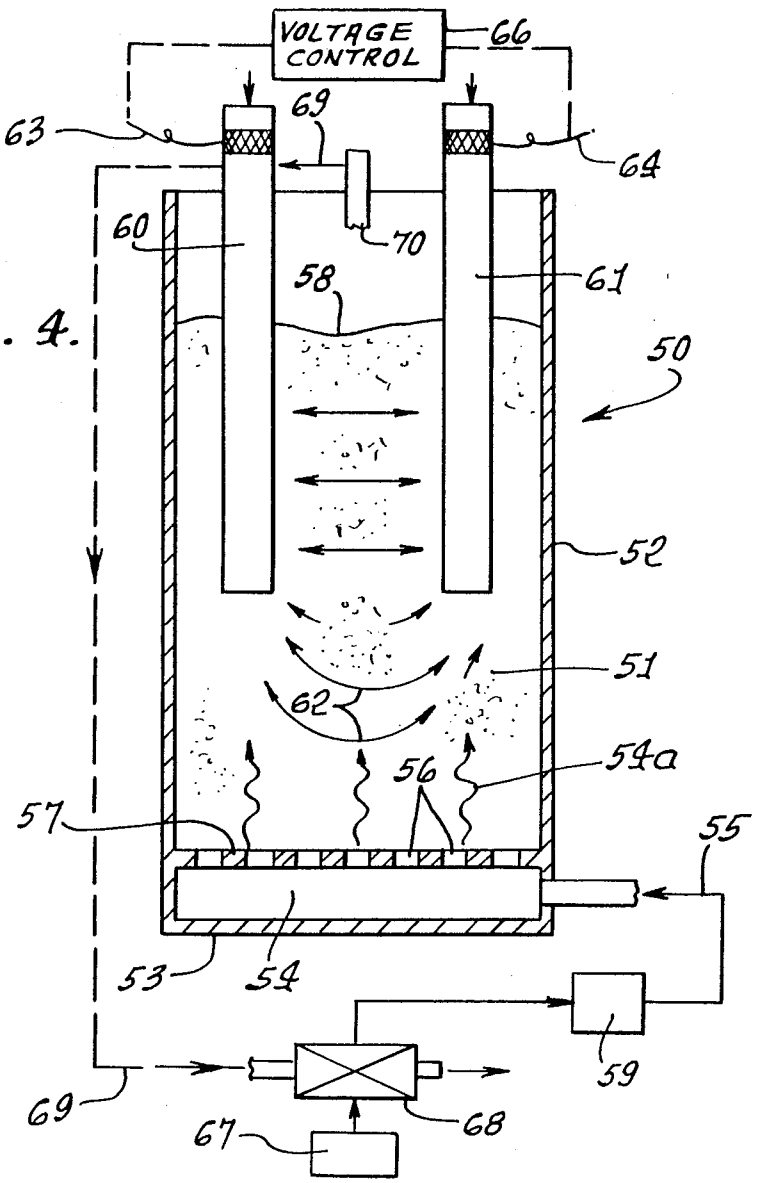
FIG. 4 is a vertical section showing one form of grain heater.

Referring now to FIG. 4, a direct resistance heating furnace or heater 50 is shown as incorporating a fluidized bed of carbonaceous particles or grain, indicated at 51. The heater includes a thin wall tube 52 of non-electrically conducting material (ceramic, for example) having the form of a right cylinder but can be triangular, square or almost any shape, from the top view. Attached and sealed to the bottom of the tube is a base 53 which is constructed as a hollow chamber, a plenum 54 located within the hollow base, and into which a non-oxidizing gas (normally nitrogen) is introduced at 55. The gas exits the plenum upwardly through a pattern of small holes 56 drilled through a diffuser plate 57. The diffuser is flat and is mounted horizontal and level. The tube's walls are perpendicular to the top of the diffuser.

The conductive "media" 51, such as a carbonaceous or graphitic media, is poured into the tube, filling the tube from the diffuser to a sufficient depth of 58. This column of media is fluidized by the gas exiting the plenum 54 at 54*a*. Fluidization causes the column of media to expand and reduces its density. By controlling the gas flow at 59, the density of the column can be controlled at specific levels. The reduction of density increases the electrical resistance of the column which increases electrical resistance heating. Fluidization also causes the column to churn and mix. This mixing rate can also be changed by changing the gas flow.

Into this column of fluidized conductive media are placed two or more electrodes 60 and 61. The electrodes are placed at a distance from each other to allow the electrical current to flow through the media between the electrodes, indicated at 62. The distance is set by the amount of resistance desired. When a voltage is applied through wires 63 and 64 attached to the electrodes, a current flows through the individual media particles and heats them. The heating rate of the particles is controlled by the voltage (see control 66) applied to the electrodes and the gas flow fluidizing the media column and varying the resistance. The heating rate of the entire column is also dependent on the mixing rate (which is controlled by the gas flow rate).

The temperature of the incoming gas can have a marked effect on the heating rate. If the inert, fluidizing gas is supplied from a vaporizing liquid source, as at 67, such as commercially available liquid nitrogen, its low temperature will cool the grain column. This cooling effect can be reduced by passing the gas through a heat exchanger 68 warmed by the exhaust 69 exiting the media heater at 70.

A test report is indicated in the Appendix showing results of heating tests with a two electrode design. The power applied to the furnace can be AC or DC. The electrodes can be made of any material that will withstand the temperature the furnace will operate at, have a low electrical resistance and can take on the shape and configuration necessary for the furnace design. A typical material is graphite.

Several modified designs are seen in FIGS. 5–8. Each of these designs take advantage of a different electrode design.

Figure 5:
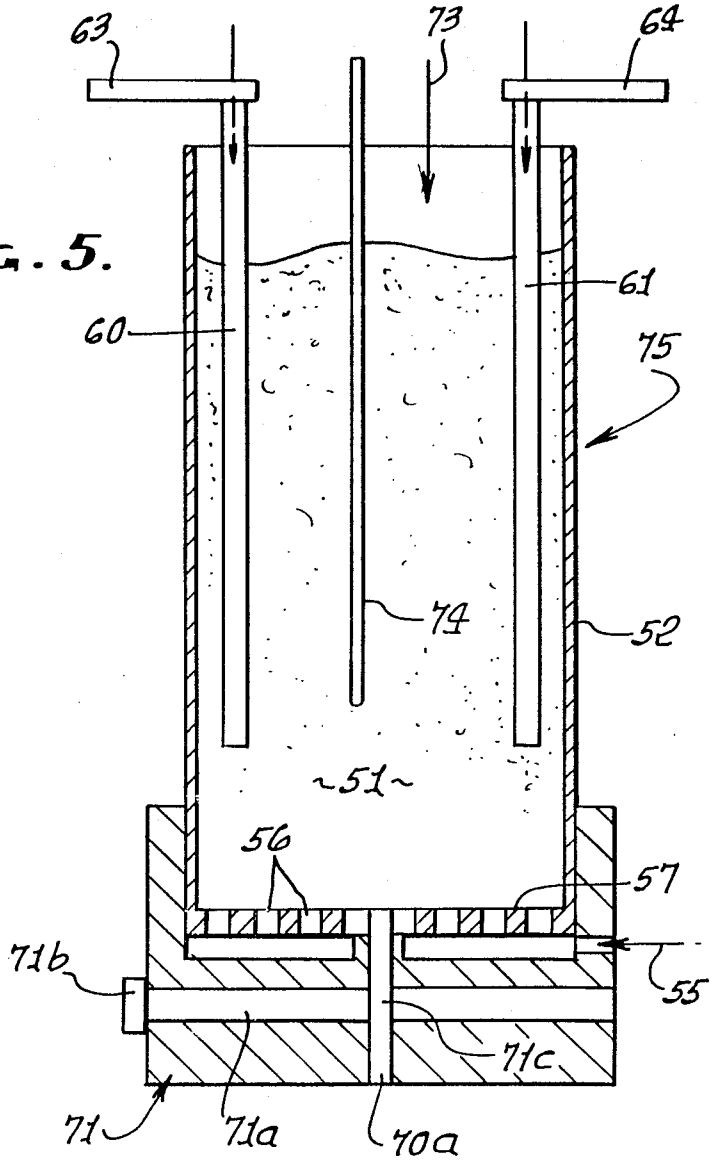
FIGS. 5–8 are vertical sections taken through modified grain heaters.

The two electrode, side-by-side device 75 of FIG. 5, is similar to FIG. 4 except that an exit port 70 within rotating valve 71 has been added to remove the heated media by a gravity pour. Valve rod 71*a* is rotated by linkage or handle 71*b*, as required, and is ported at 71*c* to pass the flow. Replacement media is added through the top at 73. A thermocouple 74 monitors the temperature of the column for the furnace controller. Another version of FIG. 5 uses three equally spaced electrodes with each connected to a leg of a three phase power supply.

FIG. 6 shows a modified heater 80 with top and bottom single phase electrodes. The electrodes are the top centered post 81 and the diffuser plate 82. Both are made of graphite and have power cables 83 and 84 bolted to them outside the hot chamber. Base 86 and power feed bus 87 are also made of graphite. Because of the graphite, the furnace is mounted in a box 88 filled with a non-oxidizing atmosphere, usually nitrogen. Tube 90 is made of a non-conductive material either ceramic or normally quartz. Because the current flows through most of the column of carbonaceous particules 91, it heats more evenly than the side-by-side electrode design. A typical device has a circular chamber 6 inches in diameter and can hold 450 cubic inches of media. Different types of media pour valves include a rolling block 71', a sliding blade, a poppet and a rotating blade. The poppet and the rotating blade have proved to be the most reliable. This design heats 450 cubic inches of media at 100° F. per minute. A thermocouple 74 or infrared thermometer is usable.

Power is supplied by a Eurotherm SCR Model 435 with a Eurotherm Model 82 controlling it. See these elements at 95 and 96 in FIG. 9. Power consumption at maximum controlled heating rate is 100 amps at 240 volts. Fluidization gas flow at operating temperature is 25 to 35 cubic feet per hour. At 25 below cfh, the bed stagnates and needs a higher flow rate pulsed through it to promote mixing.

The center electrode design shown in FIG. 7 is similar to the two electrode design of FIG. 6, except for the following differences: The outside wall 100 of the furnace is now a conductor. The other conductor is the center electrode 81, submerged into the grain. The whole unit needs oxidation protection from air to keep the furnace walls and base from attach. See box 88 containing $N_2$, and enclosing the unit.

The concentric ring unit 99 as seen in FIG. 8 has clear design advantages. Grain is introduced into the unit from the top, at 110 and is forced to the outside shell 101 along path 102. As the unit is filled, the flowable, bead-like carbonaceous grain is transferred through passages 103 in the concentric walls 104 of the electrode. Passages between such walls appear at 103*a*. The cold grain introduced into the furnace acts to insulate the furnace from any great heat loss from the sides. As the grain travels through the furnace, it is heated by the electrical current flowing between the electrode rings 112*a*, 112*b*, 112*c*, and 112*d*, the grain moves closer to the central exit 114 the flow area is smaller requiring less fluidizing gas; so the fluidizing chamber 115 is sectioned up into smaller areas. When the grain reaches the center, it is at required elevated temperature and is then insulated from heat loss by the other grain coming up to temperature around it. The center chamber is not fluidized to allow the grain to stabilize at temperature. The discharge valve 116 in the center opens to allow new grain to flow into the furnace as the hot material is dumped for supply to the consolidation die. This design allows the use of 3-phase balanced power to improve the efficiency of the power draw. See FIG. 10.

A simple block diagram for a control circuit which could be used on any of the designs is need in FIG. 9. In this case, a process controller 96 controls an SCR Pack 95. The controller outputs a phase angle signal which controls the voltage to the electrodes. Feedback is provided by the thermocouple 74 in the grain bed 91. The SCR unit has single phase AC power connected to it. The SCR Pack also includes current limiting means such that the maximum current draw is pre-set. The fluidization of the bed is controlled by a flow meter 118 which is set to the designed level. For 3-phase design, see FIG. 10.

Advantages include:

1. Faster, more economical heating of conductive or semi-conductive materials;
2. high temperature efficiently achieved;
3. single and multiple phase units as well as DC and pulsed power supplies are used:
4. self insulation of apparatus;
5. heat recovery, and heating of pre-form bodies;
6. heating material for reduction of oxides.

Figure 3:
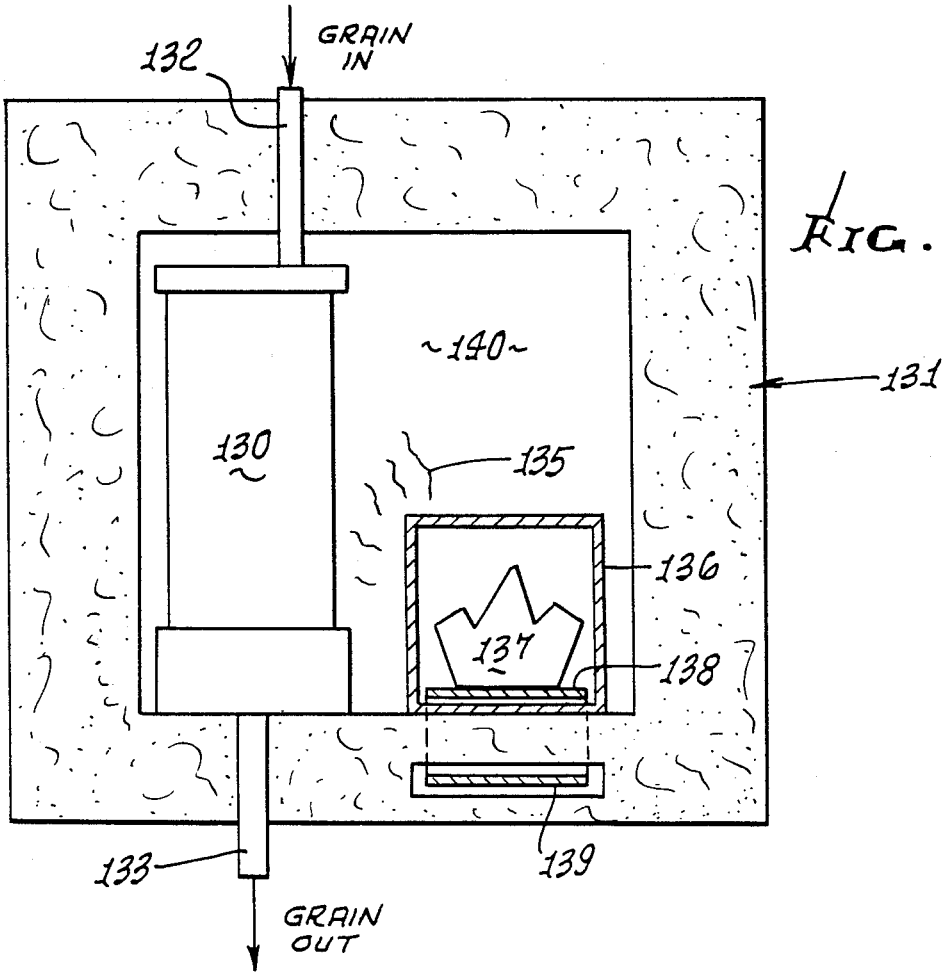
FIG. 3 is a vertical section taken through a unitized grain body heater which heats bodies to be consolidated.

In FIG. 3, the grain heater 130 may be of the type as in any of FIGS. 5–8. It is enclosed within an outer insulating chamber 131, grain entering 130 via duct 132, and discharging via duct 133, to the consolidation die. Intense heat radiates at 135 to a metallic tunnel 136 extending through the chamber 131. The tunnel in turn radiates heat inwardly to pre-form bodies 137 transported through the tunnel to heat them. Note conveyer advance and return stretches 138 and 139 that passes through the tunnel and therebelow. The tunnel ends may be open to atmosphere outside chamber 131, but the space 140 within the chamber contains $N_2$, or other inert gas.

FIG. 11 shows transfer equipment associated with the die 160, lower punch 161 and upper punch 162. Grain, heated at 130, flows downwardly to transfer cup 163 which is then shifted by robot 164 toward and above die 160. The cup is inverted, and grain is poured into the die. A pre-heated part or pre-form 165, obtained from the tunnel 136 is maneuvered by robot 166 and placed into the grain within the die. The upper punch 162 is then lowered to compress the grain which transfers pressure to the pre-form to consolidate the part. See FIG. 2. After such consolidation, the lower punch 161 is lowered and the part retrieved. The carbonaceous grain easily flows off the part and is collected in bin 169 for re-use.

At least some electrical heating of the body 137 may be effected while the body is surrounded by the graphite beads, as within a die. See FIG. 12.

Additional aspects and features include:

1. Employing the particles to be generally spheroidal and to consist of graphite;
2. the particles and the body to be consolidated, prior to said compaction, are at a temperature or temperatures between 1,000° F. and 4,000° F.;
3. the body is positioned in said bed to be surrounded by particulate, the bed consisting substantially entirely of particles in the form of graphite beads;
4. the described pressurization is carried out to compress the particulate closest to the body, so that when the compacted body is removed from said bed, the particulate closest to the body flows off the body;

5. the bed contains sufficient of the flowable carbonaceous particles as to remain essentially free of agglomeration;
6. the particle mesh size is between 50 and 240;
7. the carbonaceous particles are in the form of beads having outwardly projecting nodules therein, at least some beads having surface fissures, the particles sufficiently close together to pass the electric current, with or without fluidization.

A further feature of the invention is the consolidation, as described, of synthetic resin, as for example in initially powdered form. The resin powder may be shaped into a body as by compressive force between 10 and 190 ksi, and by heating between 700° F. to 1,500° F., and the body may then be consolidated. One example is polybenzimidazole, known commercially as CELAZOLE, a product of Hoechst Celanese Corporation, Charlotte, NC.

Depending on the application and duration, Celazole parts can withstand temperatures as high as 800° F., and in short bursts, to 1,400° F. Celazole maintains its properties in temperatures as low as −320° F. Celazole is relatively unaffected by solvents, acids, and bases--making it ideal for use in hazardous environments.

The following are typical properties of CELAZOLE U-60 - unfilled virgin polybenzimidazole resin:

| Mechanical Properties | | | |
|---|---|---|---|
| Property | ASTM Method | English Value | Metric Value |
| Tensile Strength | D638 | 23,000 psi | 160 MPa |
| Elongation | D638 | 3% | 3% |
| Tensile Modulus | D638 | 850 kpsi | 5.9 GPa |
| Tensile Fatigue, % of stress to failure at 1 million cycles, 1 Hz | | 35% (8.1 kpsi) | 35% (56 MPa) |
| Flexural Strength | D790 | 32,000 psi | 220 MPa |
| Flexural Modulus | D790 | 950 kpsi | 6.5 GPa |
| Compressive Strength | D695 | | |
| at yield (12% strain) | | 58,000 psi | 400 MPa |
| at 10% strain | | 50,000 psi | 340 MPa |
| Compressive Modulus | D695 | 900 kpsi | 6.2 GPa |
| Izod Impact Strength, | D256 | | |
| notched | | 0.5 ft-lb/in | 30 J/m |
| unnotched | | 11 ft-lb/in | 590 J/m |
| Poisson's Ratio | | 0.34 | 0.34 |

| Electrical Properties | | | |
|---|---|---|---|
| Property | ASTM Method | English Value | Metric Value |
| Dielectric Strength | D149 | 550 V/mil | 20.9 kv/mm |
| Volume Resistivity | D257 | $8 \times 10^{14}$ ohm-cm | $8 \times 10^{14}$ ohm-cm |
| Dissipation Factor | D150 | | |
| 1 kHz | | 0.000 | 0.000 |
| 10 kHz | | 0.003 | 0.003 |
| 0.1 MHz | | 0.034 | 0.034 |
| Dielectric Constant | D150 | | |
| 1 kHz | | 3.3 | 3.3 |
| 10 kHz | | 3.3 | 3.3 |
| 0.1 MHz | | 3.2 | 3.2 |
| 10 GHz | | 3.5 | 3.5 |
| Arc Resistance | D495 | 186 seconds | 186 seconds |
| Loss Tangent 8-12 GHz | | 0.004–0.006 | 0.004–0.006 |

| Thermal Properties | | | |
|---|---|---|---|
| Property | ASTM Method | English Value | Metric Value |
| Heat Deflection Temp. 264 psi | D648 | 815° F. | 435° C. |
| Glass Transition Temp. | DMA | 800° F. | 425° C. |
| Thermal Conductivity 77° F. | | 2.8 BTU-in/hr-ft$^2$ °F. | 0.41 W/m °C. |
| Coefficient of Linear Thermal Expansion | TMA | | |
| 75–300° F. | | $13 \times 10^{-6}$ in/in °F. | 23 μm/m °C. |
| 390–570° F. | | $18 \times 10^{-6}$ in/in °F. | 33 μm/m °C. |
| Limiting Oxygen Index | D2863 | 58% | 58% |

| Other Properties | | | |
|---|---|---|---|
| Property | ASTM Method | English Value | Metric Value |
| Specific Gravity | | 1.3 | 1.3 |
| Hardness | | | |
| Rockwell K | D785 | 115 | 115 |
| Rockwell M | D785 | >125 | >125 |
| Shore D | D2240 | 99 | 99 |
| Water Absorption 24 hours at 73° F. | D570 | 0.4% | 0.4% |

The consolidation process is also applicable to aluminum bodies, producing for example a higher strength and ductility aluminum 6061-T6 alloy. Average results of tensile tests have shown a 5% increase in yield strength, a 2.6% increase in tensile strength and a 25% increase in elongation to failure compared to wrought material. In addition, the processed material exhibits approximately 500% greater ductility than similar sintered aluminum alloys and extrudes further with less pressure than the wrought material. The consolidated material also has rough fracture surfaces, suggesting high fracture toughness. Furthermore, the fine grain size of the consolidated aluminum alloy leads to the expectation of good fatigue crack nucleation resistance and corrosion resistance.

The oxide layer surrounding P/M aluminum has been a major obstacle in achieving good particle bonding. The present process is able to shear this oxide layer during consolidation and promote particle bonding. As a result, consolidated P/M 6061 aluminum exhibits a significant improvement in both strength and ductility. Due to the near net shape forming capabilities of the process, the conventional extrusion step for P/M aluminum alloys can be completely eliminated in producing fully dense parts with excellent properties.

At 798K, the fracture surface indicates that particle decohesion is not observed. Surface oxide is reduced to a minimum, and there are particle boundaries where the oxide layer has disappeared completely. Like samples processed at 773K, the Fe and Mn rich dispersoids can also be observed, but they are much smaller in size than those found in the 883K processed material. In addition, there is no indication of incipient melting of the eutectic phase which can seriously degrade properties. The short cycle time of the process inhibits such localized eutectic melting.

EXAMPLE

Aluminum 6061 powder having the following particle size distribution was employed:

| Size (μm) | Volume Percent |
|---|---|
| >150 | Trace |
| >75 | 11.4 |
| >45 | 40.8 |
| <45 | 47.8 |

Pellet was preheated to about 630° F. (1,166° F.) for 9 minutes, then embedded in the pressure transmitting medium (PTM) as for example graphite, as described above, that filled the preheated die. Sufficient pressure (1.24 GPa) was applied to break the oxide layer and to achieve full density in less than one second. After releasing the pressure, the consolidated part was removed, and the hot PTM was recycled immediately into the PTM heater, as for example to be electrically heated, as described above. After solution treatment, tensile specimens were machined and heat treated to the T6 condition. Uniaxial tensile tests were performed on the Al alloy, as well as wrought aluminum 6061-T651 for mechanical property comparison. The tensile tests were conducted on an MTS servohydraulic load frame at a constant engineering strain rate of $2\times10^{-4}\,s^{-1}$. In addition, an impact extrusion test was performed to compare both materials for formability. The polished microstructures and fracture surfaces of the Ceracon material were then compared to the wrought alloy by both optical and scanning electron microscopy (SEM).

The consolidation processed P/M 6061 aluminum alloy exhibits a definite improvement in both strength and ductility compared to the wrought material. Typical tensile data for the two material are illustrated in FIG. 13. Depending on the processing conditions, the yield strength of the Ceracon 6061 ranges from 278 to 301 MPa (40.3 to 43.7 ksi), with an average of 292 MPa (42.4 ksi). The average ultimate tensile strength is 331 MPa (48.0 ksi), with a range of 306 to 349 MPa (44.4 to 50.6 ksi). These results can be compared to a yield strength of 278 MPa (40.3 ksi) and a tensile strength of 322 MPa (46.8 ksi) for the wrought material. The ductility of the processed material average 15.6%, substantially greater than the 12.3% ductility of the wrought material. The consolidated material after solution heat treatment extrudes further with a pressure 10 to 15% less than that used for the wrought material.

Comparison of results obtained from both the wrought and consolidated processed 6061 has proven that the consolidation processed 6061 exhibits superior mechanical properties (FIG. 14). Note that there is approximately a 25% increase in elongation to failure in the P/M material. This finding is unexpected due to the anticipated embrittling effect of surface oxides that are present on the starting powders. Aluminum readily reacts to air to form a stable oxide layer which can detrimentally affect the mechanical properties if the surface oxide is incompletely broken up during processing. One way to break up and distribute the oxides is by sintering the aluminum in a eutectic melt of aluminum and impurities such as Cu or Mg which can be heat treated and used in subsequent precipitation hardening. The strength of such material is comparable to wrought, but the ductility is drastically reduced. There are basically no significant improvements in the ductility even if the pre-form is sintered in pure nitrogen. The possibility of nitride formation during sintering cannot be overlooked since both nitrides and oxides can degrade the mechanical properties. For example, fracture toughness can decrease by about 50 to 70% due to nitride or oxide embrittlement.

The superior properties of the consolidated material can be related to the processing mechanism and the microstructural features revealed by both optical and scanning electron microscopy. The results from the optical evaluation of the processed 6061-T6 aluminum alloy have shown that the oxide layers are well sheared and broken, although the majority remain near the particle boundary. The mechanism of the process of P/M aluminum involves plastic deformation of the particles under high temperature and pressure. A small amount of liquid phase may exist during processing, since the consolidation is carried out at a temperature between the solidus and liquidus temperatures. However, the consolidation mechanism most likely does not involve liquid phase sintering since a recrystallized liquid phase was not found near grain boundaries. In addition, liquid phase sintering of aluminum alloys usually leads to brittle behavior, with oxide particles distributed evenly throughout the grain boundary. For example, an elongation to failure of 3% was observed for a T6 aluminum alloy with composition similar to the 6061. The consolidation material processed exhibits a 15% elongation to failure without a loss in strength. The consistency of improved strength and ductility also suggests that liquid phase sintering is not the controlling mechanism of the process. On the other hand, the controlling mechanism can be envisaged as severe plastic deformation of the aluminum particles leading to surface oxide breakup. Where the oxide layer was sheared, metal-metal diffusion bonding can take place and increase the bonding strength between the individual particles.

On polished specimens, scanning electron microscopy reveal the existence of relatively large 5–10 m particles embedded in the aluminum matrix of the wrought materials. No similar particles were observed in the consolidation processed material. These particles appear to have a more deleterious effect on the ductility than the surface oxides trapped during the consolidation. The surface oxides in the processed material may actually be very effective in maintaining the fine grain size during heat treatment if they are able to pin grain boundaries. This would account for the higher strength of the P/M material. In addition, scanning electron micrographs of the fracture surfaces reveal fine grain size, suggesting good fatigue crack initiation resistance and stress corrosion resistance in the P/M sample. The rough appearance of the fracture surface also suggests higher fracture toughness for the P/M alloy.

Note also the following tables:

TABLE 1

| | Experimental Mixtures of 2124 Al Powder | | | | |
|---|---|---|---|---|---|
| Mesh | Group 1 | Group 2 | Group 3 | Group 4 | Group 5 |
| −60/+230 | 67% | 60% | 55% | 50% | 45% |
| −325 | 33% | 40% | 45% | 50% | 55% |

TABLE 2

| | Tensile Properties of Consolidation Processed Al 2124-T4 at 798K | | | |
|---|---|---|---|---|
| | σy (MPa) | UTS (MPa) | % Elongation | BHN |
| Group 2 | 320 | 477 | 16.7 | 121 |
| Group 3 | 325 | 481 | 16.3 | 120 |
| Group 4 | 317 | 474 | 16.7 | 118 |
| Group 5 | 319 | 479 | 16.6 | 124 |

TABLE 3

| Comparison of Consolidation Processed and Wrought Material Properties | | | | |
|---|---|---|---|---|
| | σy (MPa) | UTS (MPa) | % Elongation | BHN |
| Group 2 | 320 | 477 | 17 | 121 |
| 2024-T4,T351 | 325 | 470 | 20 | 120 |
| 2124-T351 | 325 | 470 | 20 | 120 |

APPENDIX

A test fixture was constructed using a quartz retort with a three inch O.D., 0.100 wall 17 inches high. Two inches of alumina rock was placed into the bottom above the perforated plate of the plenum. Nitrogen is fed into the plenum, through the perforations, through rock into the grain. This fluidizes the bed and gives the agitation necessary to allow mixing of the graphite grain. The electrodes were hung vertically into the bed (on opposite sides). The electrodes are 12½ inches long.

The parameters to be investigated were electrode diameter, electrode length, gas flow, power draw, current type and frequency, electrode spacing, electrode alignment, and the affect this heating method has on the grain.

Test #1

⅜ inch O.A. electrodes were used, spaced two inches apart. Current was set to 60 cycle A.C. and used for all following experiments. The power was turned on for one minute then shut off and a thermocouple was inserted for a temperature reading. The gas flow and amperage were arbitrarily set. Grain was heated from room temperature to 1130° C. in 21 minutes (power on).

Test #2

Amperage was controlled at 75±5 amps. The bed was heated for six minutes from room temperature; the power turned off and a temperature reading (500° C.) taken. Power was turned back on for five minutes. Temperature of the bed reached a maximum of 1112° C., but the temperature was not uniform through the bed.

Test #3A

⅜ inch electrodes were tried, and it was found they heated up too fast. The amperage draw was the same as the ⅜ inch electrodes. Electrodes were changed to ⅜ inch and the bed heated while controlling the gas flow between 350 and 500 ccm. In the first five minutes the temperature went from 84° C. to 500° C. In the following six months 750° C. was reached; 950° C. in another five minutes; and 1100° C. in two more.

The bed was not fluidized well and there were cold spots. The electrodes were trapping grain and preventing grain mixing.

Test #3B

The electrodes were moved ½ inch away from the retort wall. Grain was heated from 690° C. to 1040° C. in seven minutes. Fluidization was much better.

Test #4A, 4B, 5

In tests #4A, 4B, and 5, a constant amperage was maintained to find out what the temperatures were after eleven minutes. In #4A, the amperage was set to 50±5. Starting from 500° C., the bed reached 1000° C.

In #4B, the amperage was set to 35+5 amps and the bed went from 500° C. to 900° C. Interestingly, at very high flow rates (2400 ccm+), very high wattage readings were recorded.

Test #5 was run at 65±5 amps and heated from 500° C. to 1196° C. in eleven minutes. The hottest grain zone appeared to be at the end of the electrodes.

Test #6A, 6B, 6C

With tests #6A, 6B, and 6C, the grain level was lowered two inches to nine inches high to investigate the high flow--high wattage phenomenon. The gas flow was at 3000 ccm for test #6A. Amperage and voltage were erratic, but the wattage was very high. Despite this, grain bed temperature rose from 500° C. to 900° C. in eleven minutes. It would appear the thermal loses were too great with the excess flow.

Test #6B was to see how the bed heats at this lower grain level at 70±5 amps. It rose from 500° C. to 1200° C. in six minutes.

Test #6C is to study the relationship between flow and amperage. The following are findings:

Flow (ccm) 0 200 400 600 800 1000 1500 2000 2500

Amps 108 106 96 42 46 47 55 67 77

Amperage appears related to gas flow because it changes the bed density.

Test #7

The grain level was returned to eleven inches and the amperage set at 60±5. With the bed starting at 500° C., the test was run for eleven minutes. Bed temperatures were taken with five thermocouples in a grid and the average temperature was 1050° C. At this low flow rate the grain bed has distinct heat pockets but even out in one minute after heating is discontinued.

Test #8

This test was to determine what temperature can be achieved by maintaining 45±5 amps for eleven minutes. The grain depth was eleven inches with the electrodes six inches into the grain. The electrodes are still ⅜ inch diameter graphite, 1½ inches apart, center-line to center-line. With the flow at 550 ccm+, the bed temperature was far more even than in test #7, but the average bed temperature was lower. It was found that the retort must be vertical for test fluidization.

Test #9A

Test #9A was for the purpose of investigating the high flow and power phenomenon. Grain level was lowered to nine inches and electrode placement remained the same, except for depth in the grain. Flow was held at 3000 ccm for the test. Starting temperature was 500° C. and ending temperature was 900° C. Bed temperature was very uniform but low considering the power used.

Test #9B

In this test, the attempt was to achieve uniform bed temperature with good heating. The flow was set at 1200 ccm. The set up was the same as Test #9A. Bed temperature started at 495° C. and average ending temperature was about 1000° C. Bed temperature was more uniform. Cool off rate for the bed is more rapid.

Test #10

The gas glow was raised to 1500 ccm to check bed uniformity. The electrode placement and the grain level remained the same. Bed temperature started at 300° C. and heating continued for twelve minutes. The ending temperature was about 950° C. and the bed temperature was uniform to within 20° C.

Test #11

In this test, the gas flow was reduced to 400 ccm to find the hottest zones in the retort. The electrode placement and grain level remained the same as the previous tests. Heating was from room temperature, for ten minutes. The area near the end of the electrodes proved to be hotter than the others, but one side of the retort was much hotter than the other. This is probably due to unequal fluidization.

Test #12

This test produced an interesting result even though there was failure to get bed heat. Using undersize electrodes, the electrodes became hot but not the grain. The rods use up the power. Grain was added to the retort to increase the contact with the electrodes but still didn't produce as much heat. There is a definite limit on how small an electrode can be.

Results

Electrode diameter:
It should be large enough to handle the amperage but excessive size interferes with fluidization.

Electrode length:
The heat zone ends at the end of the rods so this can be set where bed heating is needed.

Gas flow:
To get an even heated fluid bed, the flow must be sufficient to agitate the grain well.

Power amount:
Power amount can be adjusted with gas flow. If a very evenly heated bed is desired, slower heating is needed.

Current Type:
AC 60 cycle works very nicely and should be the cheapest to provide.

Electrode Distance Apart:
The closer the electrodes are to each other, the smaller the heat circle is, and the greater the localized heating.

Electrode alignment:
This is similar to the distance apart. The better the alignment, the smaller the heat circle.

Grain effect:
Samples indicate the grain is unaffected by the heating method.

The above results are obtained from a small retort with the electrodes only 1 5/16 inches apart. With a larger retort, the size of the electrode, voltage, grain volume, and flow rates will need to increase.

I claim:

1. In the method of consolidating a body in any of initially powdered, sintered, fibrous, sponge, or other form capable of compaction, that includes the steps:

(a) providing a bed of flowable particles within a contained zone, said particulate including flowable and resiliently compressible carbonaceous particles;

(b) positioning said body in said bed, to be surrounded by said particles;

(c) effecting pressurization of said bed to cause pressure transmission via said particles to said body, thereby to compact the body into desired shape, increasing its density;

(d) the particles being heated to elevated temperature prior to compacting of the body into desired shape;

(e) the heating of the particles being effected by passing electric current through same, and heat generated in the particles also to be transferred to said body; and (f) the body to be consolidated consisting of one of the following:

(i) ceramic material (ii) a mixture of metallic and ceramic material.

2. The method of claim 1 including placing electrode means in a mass of the particles.

3. The method of claim 1 including fluidizing said heated mass of particles.

4. The method of claim 3 wherein said fluidizing is carried out by passing gas into the bed, during passing of electric current through particles in the bed.

5. The method of claim 2 wherein the electrode means comprise two electrodes penetrating into the bed, and confining the bed at locations spaced about the electrodes.

6. The method of claim 2 wherein the electrode means comprise one electrode penetrating into the bed, and another electrode at the bottom of the bed, and including confining the bed at locations spaced about said one electrode.

7. The method of claim 5 including excluding entrance of air to the bed during said passage of electric current.

8. The method of claim 6 including excluding entrance of air to the bed during said passage of electric current.

9. The method of claim 1 including confining said particles in a column during said heating thereof.

10. The method of claim 1 including confining said particles in a column during said heating thereof, the electrode means being placed into said column.

11. The method of claim 1 including also placing the body in heat receiving proximity to said particles through which electrical current passes.

12. The method of claim 1 wherein said particles are generally spheroidal and consist of graphite.

13. The method of claim 1 wherein said (b) step is carried out at elevated temperatures.

14. The method of claim 1 wherein said body in said bed, prior to said compaction, is at a temperature between about 1,000° F. and 4,000° F.

15. The method of claim 1 wherein said body is positioned in said bed to be surrounded by said particulate, the bed consisting substantially entirely of particles in the form of graphite beads.

16. The method of claim 1 wherein said pressurization is carried out to compress the particulate closest to the body, so that when the compacted body is removed from said bed, the particulate closest to the body flows off the body.

17. The method of claim 1 wherein said bed contains sufficient of said flowable carbonaceous particles as to remain essentially free of agglomeration during said (c) step.

18. The method of claim 1 wherein said bed consists essentially of all graphite particles.

19. The method of claim 1 wherein the particle mesh size is between 50 and 240.

20. The method of claim 1 wherein said carbonaceous particles are in the form of beads having outwardly projecting nodules therein, at least some beads having surface fissures, the particles being sufficiently close together to pass the electric current.

21. The method of claim 1 wherein said heating of the particles is effected outside said contained zone wherein the body is positioned, and including transferring said heated particles into said zone.

22. The method of claim 21 wherein said transferring includes pouring the heated particles into said zone, and providing an inert gas atmosphere wherein said pouring is carried out.

23. The method of claim 21 including providing an inert gas atmosphere wherein said transferring is carried out.

24. The method of claim 21 including providing a particle receiver, and providing electrode means exposed to the interior of the receiver wherein said heating of the particles is carried out by passage of electrical current between said electrode means.

25. The method of claim 24 including passing said particles in a stream through said receiver, to be heated therein.

26. The method of claim 1 including pre-heating said body by transfer of heat from said particles to the body.

27. The method of claim 26 wherein said pre-heating of the body is carried out externally of said contained zone.

28. The method of claim 24 including pre-heating said body by transfer of heat from said receiver to the body.

29. The method of claim 28 including providing an inert gas atmosphere wherein said transfer of heat to the body is carried out.

30. The method of claim 28 including transferring the pre-heated body to said contained zone.

31. The method of claim 11 wherein the body is placed in contact with the particles to receive heat therefrom, prior to and during said pressurization of the particles.

32. The method of claim 11 including providing a receiver in which the particles are placed and wherein the particles receive said electrical current, and including placing the body in proximity to said receiver to receive heat transmission therefrom, the body subsequently being placed in said bed.

33. The method of claim 3 including controlling said fluidizing to control the electrical resistance of said particles during said passage of current through same.

34. The method of claim 4 including controlling the temperature of the fluidizing gas to control the temperature of the particles.

35. The method of claim 32 including employing said receiver as electrode means via which said current passes.

36. The method of claim 2 wherein the electrode means comprises multiple electrodes to which 3-phase current is supplied.

37. The method of claim 2 wherein said electrode means comprise concentric rings between which the particles are caused to flow.

38. The method of claim 2 including employing an SCR unit, and a control unit therefore, to control said current passage to the particles.

39. The method of claim 1 wherein said metallic material consists essentially of aluminum, and including placing electrical means in said bed of particles.

40. The method of claim 1 wherein consolidation occurs at pressure in the range 10 to 190 ksi exerted via the particles in the bed.

41. The method of consolidating a body in any of initially powdered, sintered, fibrous, sponge, or other form capable of compaction, that includes the steps:

(a) providing a bed of flowable particles within a contained zone, said particulate including flowable and resiliently compressible carbonaceous particles;

(b) positioning said body in said bed, to be surrounded by said particles;

(c) effecting pressurization of said bed to cause pressure transmission via said particles to said body, thereby to compact the body into desired shape, increasing the density; and (d) the body to be consolidated consisting essentially of aluminum, (e) the particles being electrically heated to elevated temperatures prior to compacting of the body into desired shape.

42. The method of consolidating a body in any of initially powdered, sintered, fibrous, sponge, or other form capable of compaction, that includes the steps:

(a) providing a bed of flowable particles within a contained zone, said particulate including flowable and resiliently compressible carbonaceous particles;

(b) positioning said body in said bed, to be surrounded by said particles;

(c) effecting pressurization of said bed to cause pressure transmission via said particles to said body, thereby to compact the body into desires shape, increasing the density; and (d) the body to be consolidated consisting essentially of synthetic resin, (e) the particles being electrically heated to elevated temperatures prior to compacting of the body into desired shape.

43. The method of claim 42 wherein said resin consists of polybenzimidazole.

44. The method of claim 42 wherein said resin body is in initially powdered form.

* * * * *